US008967229B2

(12) United States Patent
Okabe et al.

(10) Patent No.: US 8,967,229 B2
(45) Date of Patent: Mar. 3, 2015

(54) METHOD OF MANUFACTURING A MOLD FOR PRESS FORMING EMPLOYING AN EVAPORATIVE PATTERN

(75) Inventors: Susumu Okabe, Toyota (JP); Masanori Sato, Toyota (JP); Masashi Takahashi, Toyota (JP); Tsuyoshi Nanba, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/878,247

(22) PCT Filed: Jan. 28, 2011

(86) PCT No.: PCT/JP2011/051825

§ 371 (c)(1),
(2), (4) Date: Apr. 8, 2013

(87) PCT Pub. No.: WO2012/101829

PCT Pub. Date: Aug. 2, 2012

(65) Prior Publication Data

US 2013/0292080 A1 Nov. 7, 2013

(51) Int. Cl.

| | |
|---|---|
| ***B22C 9/02*** | (2006.01) |
| ***B22C 15/00*** | (2006.01) |
| ***B22C 9/04*** | (2006.01) |
| ***B22C 7/02*** | (2006.01) |
| ***B22C 9/18*** | (2006.01) |
| ***B22D 25/02*** | (2006.01) |

(52) U.S. Cl.

CPC ..... *B22C 9/046* (2013.01); *B22C 7/026* (2013.01); *B22C 9/18* (2013.01); *B22D 25/02* (2013.01)

USPC ..... 164/34; 164/37

(58) Field of Classification Search

CPC ..... B22C 9/04; B22C 9/046; B22C 15/10; B22C 9/10; B22C 7/02; B22C 9/123; B22C 7/00; B22C 7/023; B22C 7/005

USPC ..... 164/34, 35, 37, 45, 159, 235, 246, 249

See application file for complete search history.

(56) References Cited

U.S. PATENT DOCUMENTS

| | | | | | |
|---|---|---|---|---|---|
| 4,443,259 | A | * | 4/1984 | Nooden | 106/38.27 |
| 4,616,689 | A | * | 10/1986 | Denis | 164/34 |
| 5,223,051 | A | * | 6/1993 | Ryntz, Jr. | 148/538 |
| 6,007,280 | A | | 12/1999 | Asahi et al. | |

FOREIGN PATENT DOCUMENTS

| | | | |
|---|---|---|---|
| JP | A-61-266147 | | 11/1986 |
| JP | 07323400 | A * | 12/1995 |
| JP | A-10-216898 | | 8/1998 |

OTHER PUBLICATIONS

English machine translation of JP-07-323400.*

* cited by examiner

*Primary Examiner* — Kevin P Kerns
*Assistant Examiner* — Steven Ha
(74) *Attorney, Agent, or Firm* — Oliff PLC

(57) ABSTRACT

An evaporative pattern casting method is taught which does not reduce accuracy of an evaporative pattern.

The evaporative pattern casting method comprises a part manufacturing process (S2), an assembly process (S4), a sand mold manufacturing process (S6), a molten metal pouring process (S8) and a sand removal process (S12). In the part manufacturing process, the evaporative pattern is manufactured as a plurality of separate parts. In the assembly process, the parts are assembled on a work plane. In the sand mold manufacturing process, the evaporative pattern is covered with sand to form a sand mold without moving the assembled evaporative pattern from the work plane. In the molten metal pouring process, molten metal is poured into the sand mold. In the sand removal process, the sand is removed after the molten metal has solidified. According to this casting method, the sand mold is formed without moving the assembled evaporative pattern from the work plane, and consequently the accuracy of the dimensions at the time of assembly can be maintained.

1 Claim, 8 Drawing Sheets

METHOD OF MANUFACTURING A MOLD FOR PRESS FORMING EMPLOYING AN EVAPORATIVE PATTERN

TECHNICAL FIELD

The present invention relates to an evaporative pattern casting method.

BACKGROUND ART

Evaporative pattern casting is a type of casting method, and is also called full-mold casting. An outline of this method is as follows. First, a pattern is made from an evaporative material that evaporates by the heat of molten metal. This pattern is called an evaporative pattern. Next, a sand mold is made in which the evaporative pattern is embedded. Molten metal is poured into a cavity of the sand mold. Here, "cavity" means a space in the sand mold occupied by the evaporative pattern. When the molten metal is poured, the evaporative pattern is evaporated (melted or burnt) by the heat of the molten metal, and the space which had been occupied by the evaporative pattern is filled by the molten metal. After the molten metal has cooled and solidified, the sand mold is removed, completing a cast structure having exactly the same shape as the evaporative pattern. Typically, polystyrene foam or wax is employed as the evaporative material.

The structural strength (rigidity) of polystyrene foam or wax is low, and consequently when a large-scale evaporative pattern was to be made, the evaporative pattern was manufactured as a plurality of separate parts, and then the parts were assembled. For example, a method of manufacturing an evaporative pattern as a plurality of separate parts is disclosed in Patent Document 1.

CITATION LIST

Patent Literature

Patent Document 1: Japanese Patent Application Publication No. H10-216898

SUMMARY OF THE INVENTION

Technical Problem

Conventionally, after the plurality of parts had been assembled, the assembled evaporative pattern was moved in order to make the sand mold. Moving the assembled evaporative pattern has the risk that the evaporative pattern could bend due to its low structural strength. Upon bending, the dimensions of the evaporative pattern might change. The present specification presents an evaporative pattern casting method which does not reduce the accuracy of the evaporative pattern.

Solution to the Technical Problem

An evaporative pattern casting method taught in the present specification comprises a part manufacturing process, a part assembly process, a sand mold manufacturing process, a molten metal pouring process, and a sand removal process. In the part manufacturing process, the evaporative pattern is manufactured as a plurality of separate parts. In the part assembly process, the parts are assembled on a work plane. Here, the work plane is a plane provided by a floor, concrete, or metal. In the sand mold manufacturing process, the sand mold is formed by covering the evaporative pattern with sand without moving the assembled evaporative pattern from the work plane. That is, the sand mold is formed on the work plane. In the molten metal pouring process, molten metal is poured into the sand mold. In the sand removal process, the sand is removed (the sand mold is broken) after the molten metal has solidified. In this method, the sand mold is formed without moving the evaporative pattern from the work plane once the evaporative pattern has been assembled, and consequently the accuracy of the dimensions at the time of assembly can be maintained. That is, according to this method, a cast can be obtained having substantially the same accuracy of dimensions as the accuracy of dimensions at the time of assembly.

In another aspect of the evaporative pattern casting method taught in the present specification, a process of applying mold lubricant is preferably performed before assembling the parts. In case mold lubricant is applied after the evaporative pattern has been assembled, the evaporative pattern may be moved. If each of the parts has the mold lubricant applied thereto before assembly, and then the parts are assembled, the evaporative pattern need not be moved. An example of the mold lubricant is a mold release agent for making it easier to remove sand from the cast. Further, in case the material of the evaporative pattern is polystyrene foam, the mold lubricant may include a substance that absorbs gas that occurs when the evaporative pattern melts.

The evaporative pattern casting method taught in the present specification is suitable for a method of manufacturing a mold for press forming. In particular, the evaporative pattern casting method is suitable for casting a mold configured of a positioning block for positioning the evaporative pattern relative to a contraposed mold, a design block comprising a design surface for transcribing a target shape to a workpiece (a metal plate), and a plurality of rods connecting the positioning block and the design block. In this case, the evaporative pattern is preferably constructed by manufacturing the positioning block, the design block and the plurality of rods separately, then assembling the separate parts. The evaporative pattern with the plurality of rod-shaped members bends easily. In the evaporative pattern casting method described above, the assembled evaporative pattern does not need to be moved, and consequently this evaporative pattern casting method is suitable for casting that employs an evaporative pattern in which a plurality of blocks is connected by the rod-shaped members.

DESCRIPTION OF EMBODIMENTS

Figure 1:
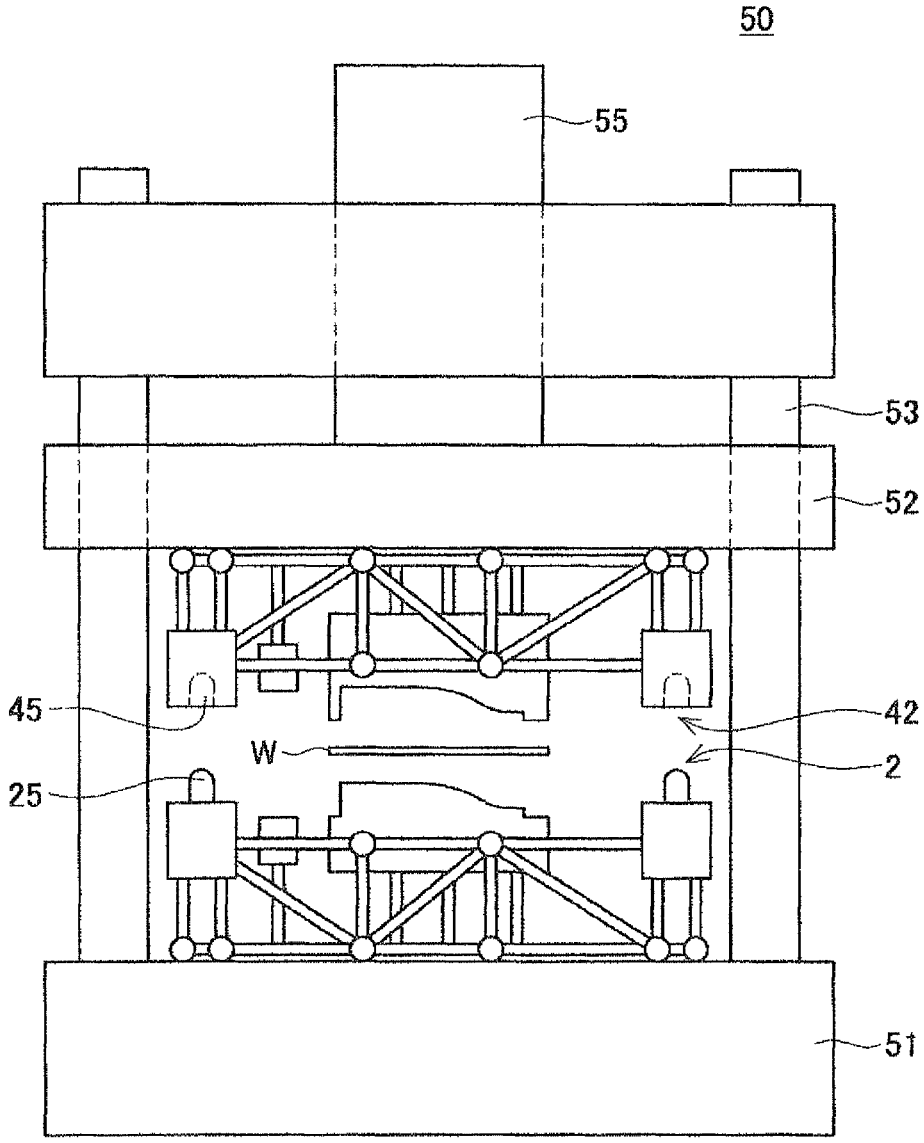
FIG. 1 shows a schematic side view of a press machine.
Figure 2A:
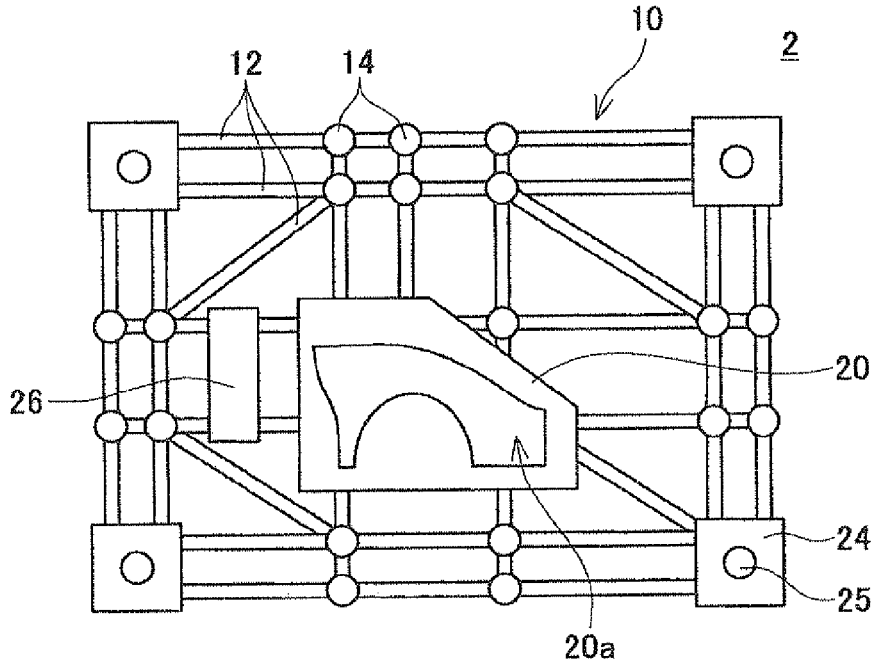
FIG. 2A shows a plan view of a mold (evaporative pattern).
Figure 2B:
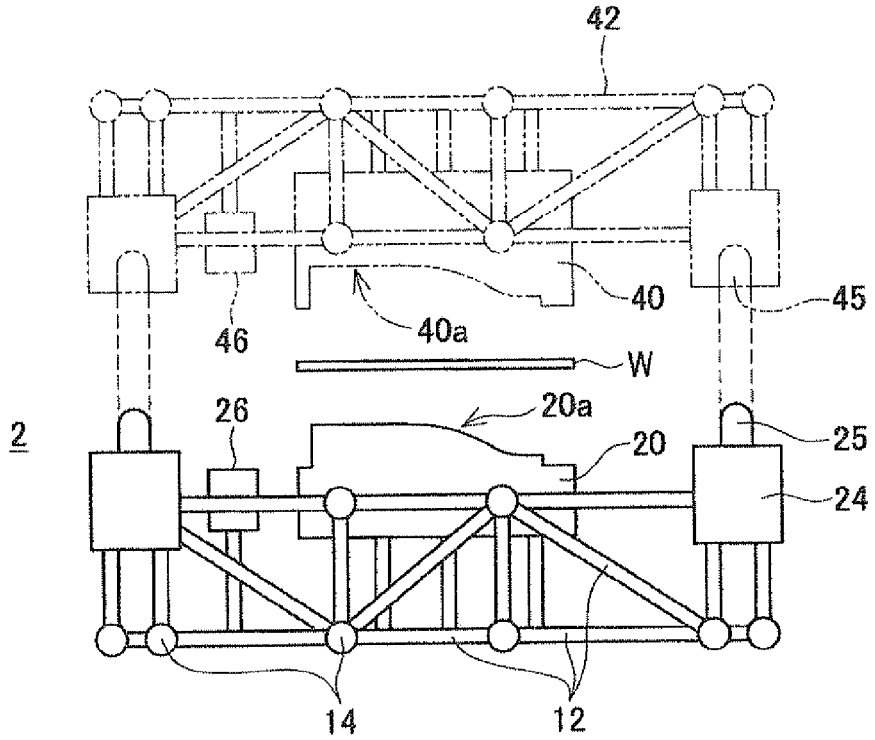
FIG. 2B shows a side view of the mold (evaporative pattern).

First, a target to be cast by the casting method of the embodiment will be described. In the present embodiment, a die for press forming is the target cast product. To aid understanding, first an example of usage of a die for mechanical pressing will be described. FIG. 1 shows a schematic side view of a press machine 50 comprising molds 2, 42. The mold 2 is a lower mold, and the mold 42 is an upper mold. FIG. 2A is a plan view of the mold 2, and FIG. 2B is a side view of the mold 2. In FIG. 2B, the mold 42 (the upper mold) that corresponds to the mold 2 (the lower mold) is also shown. The mold 2 is fixed to a bolster 51, and the mold 42 is fixed to a slider 52. The slider 52 is moved up and down by an actuator 55 while being guided by supports 53.

The mold 2 has a design block 20, positioning blocks 24, and a supporting block 26. The design block 20 has a design surface 20*a* for transcribing a target shape to a workpiece (a metal plate). The mold 2 of this example is a mold for press forming a fender of an automobile. The design surface 20*a* is formed in the shape of the fender. The positioning blocks 24 are located in the four corners of the mold 2. It should be noted that the number 24 has been appended to only one of the positioning blocks in the figure, and the number has been omitted on the other positioning blocks.

A workpiece W is sandwiched between the design block 20 of the mold 2 and a design block 40 of the mold 42, and the actuator 55 lowers the slider 52. Design surfaces 20*a*, 40*a* are pressed against the workpiece W. When load is applied further, the workpiece W deforms to the shape of the design surface 20*a*. That is, the shape of the design surfaces 20*a*, 40*a* is transcribed to the workpiece W.

When the mold 2 and the mold 42 are to be fitted together, guide pins 25 of the mold 2 (the lower mold) fit into guide bushes 45 of the mold 42 (the upper mold), allowing the mold 2 and the mold 42 to be positioned relative to one another. That is, the design surface 20*a* of the mold 2 and the design surface 40*a* of the mold 42 can be positioned relative to one another. The guide pins 25 are formed on the positioning blocks 24, respectively. As shown in FIG. 2A, the positioning blocks 24 are located in the four corners of the mold 2 so as to surround the design block 20. By locating the positioning blocks 24 at the four corners of the design block 20, the relative position of the design surface 20*a* of the mold 2 and the design surface 40*a* of the mold 42 can be determined accurately.

The supporting block 26 is a block to which a variety of tools used in press loading is attached. The type of tool is, for example, a tool to bend round an edge of the work, a punch tool for making a horizontal through hole through the work, etc. A supporting block 46 that corresponds to the supporting block 26 is attached to the mold 42. A tool positioned between the supporting blocks 26 and 46 is a tool operated as a driving force for a load when the supporting blocks 26 and 46 are to be moved closer together.

The design block 20, the positioning blocks 24 and the supporting block 26 are mutually connected by a plurality of rods 12 (rod-shaped members). Connecting portions of the rods are called "joints 14". It should be noted that reference numbers have been appended only to the rods and joints of one part in the figure, and reference numbers for the other rods and joints have been omitted. The plurality of rods 12 are combined vertically, horizontally and diagonally to form a frame 10. In case the latticed window surrounded by the plurality of rods 12 is rectangular, the rods 12 form a Rahmen structure. At the triangular-shaped part of the latticed window surrounded by the plurality of rods 12, the rods 12 form a truss structure. The frame 10 has a framework structure. Moreover, the truss structure refers to a framework structure in which only axial force acts on the rods and moment does not act thereon, and the Rahmen structure refers to a framework structure in which both axial force and moment act on the rods. Both the Rahmen structure and the truss structure consist only of the rods, and consequently are lightweight with high structural strength. Moreover, the entire pattern has adequate flexibility.

Figure 3:
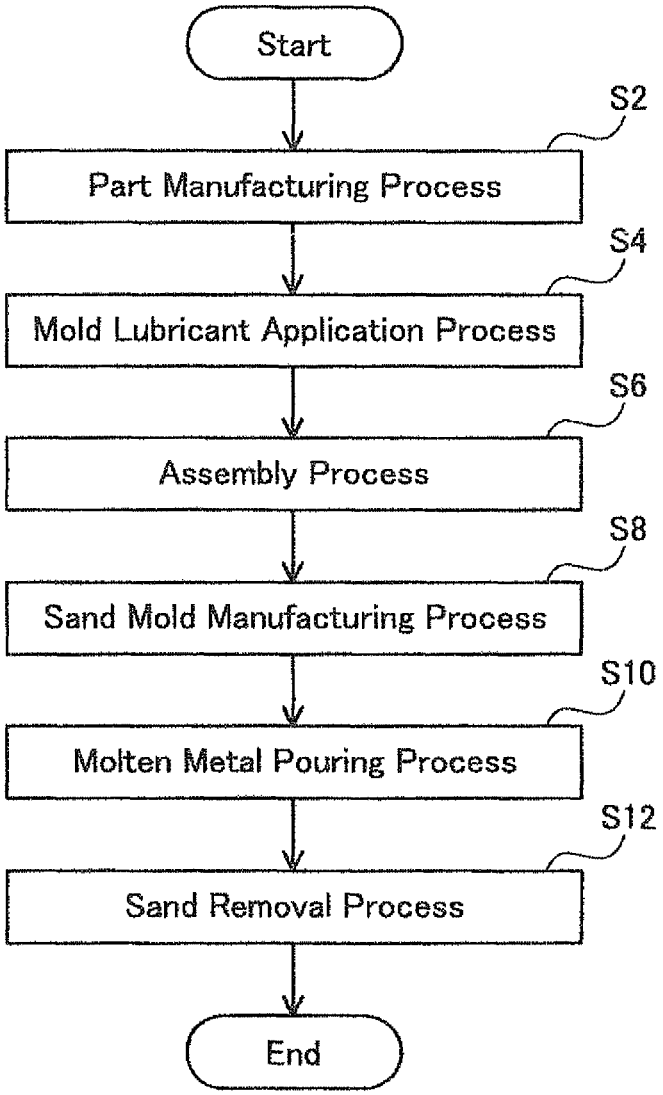
FIG. 3 shows a flowchart of an evaporative pattern casting method.

The mold 2 is a cast product made by evaporative pattern casting (full-mold casting). Next, the casting method of the mold 2 will be described. FIG. 3 shows a flowchart of the casting method of the embodiment. The casting method comprises a part manufacturing process (S2), a mold lubricant application process (S4), an assembly process (S6), a sand mold manufacturing process (S8), a molten metal pouring process (S10) and a sand removal process (S12). As described above, high structural strength can be expected from the framework structure, but a framework structure having sufficient structural strength cannot necessarily be achieved with the evaporative material (polystyrene foam). In particular, in case a large-scale evaporative pattern is made, there is a risk of the structural strength of the evaporative material being insufficient. The evaporative pattern casting method described below is suitable for a large evaporative pattern having the framework structure, can prevent bending of the evaporative pattern, and can suppress a reduction in accuracy of the dimensions of the evaporative pattern (the cast product).

Figure 4:
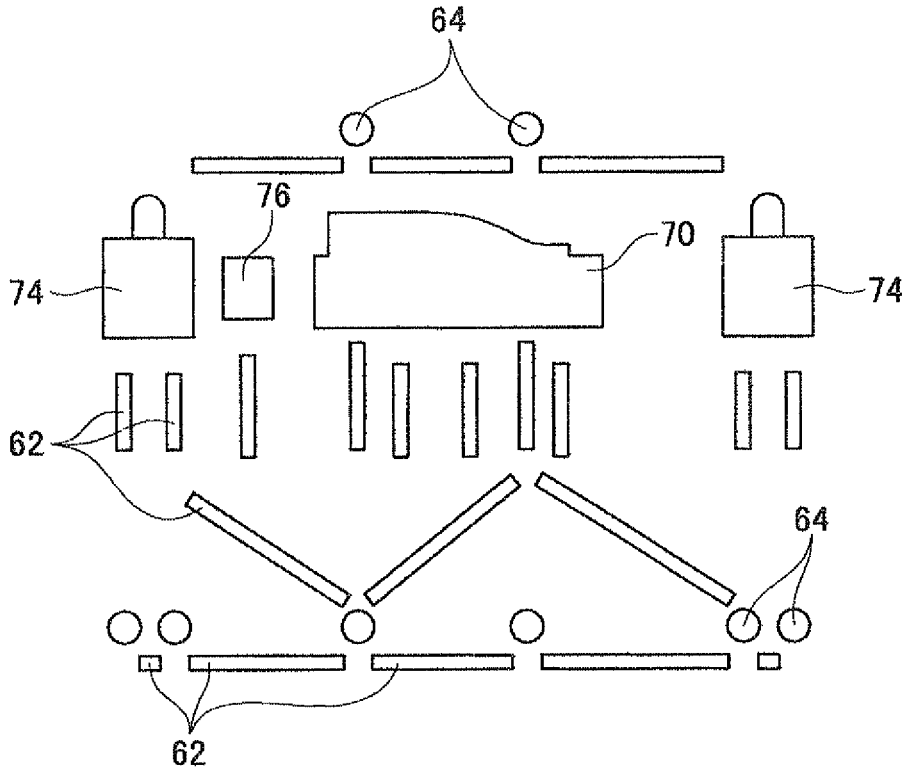
FIG. 4 shows a part drawing of the evaporative pattern.

(Part Manufacturing Process) First, an evaporative pattern having the same shape as the mold 2 shown in FIG. 2A and FIG. 2B is manufactured (FIG. 4). The evaporative pattern is manufactured as a plurality of separate parts. The evaporative pattern is made from polystyrene foam. FIG. 4 shows a part drawing of the evaporative pattern. The parts indicated by reference number 64 are pattern parts corresponding to the joints 14 of the mold 2 shown in FIG. 2A and FIG. 2B. The parts indicated by reference number 62 are pattern parts corresponding to the rods 12 of the mold 2. The part indicated by reference number 70 is a part corresponding to the design block 20 of the mold 2. The parts indicated by reference number 74 are parts corresponding to the positioning blocks of the mold 2. The part indicated by reference number 76 is a part corresponding to the supporting block 26 of the mold 2. Each part is made separately. Moreover, the pattern parts corresponding to each block may be made separately as a plurality of sub parts.

Figure 5:
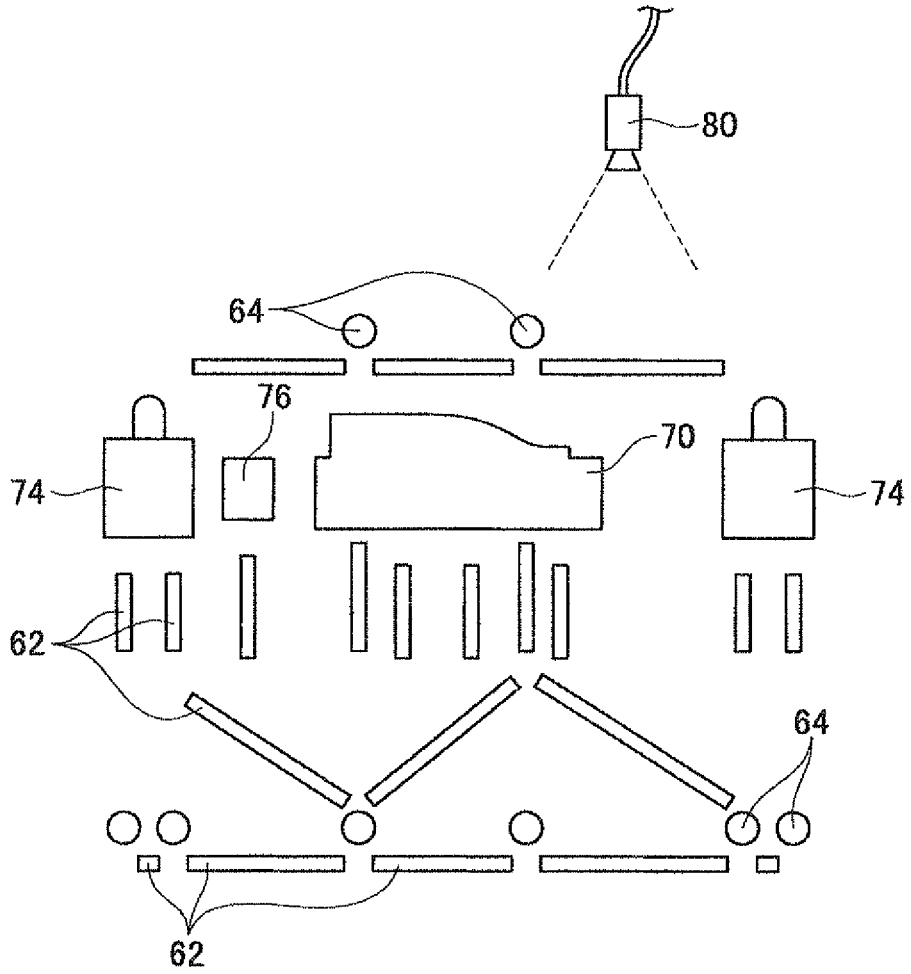
FIG. 5 is a figure illustrating a mold lubricant application process.

(Mold lubricant Application Process) After the parts have been manufactured separately, the mold lubricant is applied to each of the parts (FIG. 5), The mold lubricant is sprayed onto each of the parts by using a spray 80. The mold lubricant may be emulsified wax, graphite particles colloidally dispersed in water, an additive mixed into a lubricant, or a heat-resistant pigment, such as mica, dispersed in water, etc. The additive mixed into the lubricant is equivalent to a mold release agent. Further, the mold lubricant may include a material that absorbs the gas that occurs when the evaporative pattern is melted by the heat of the molten metal.

Figure 6:
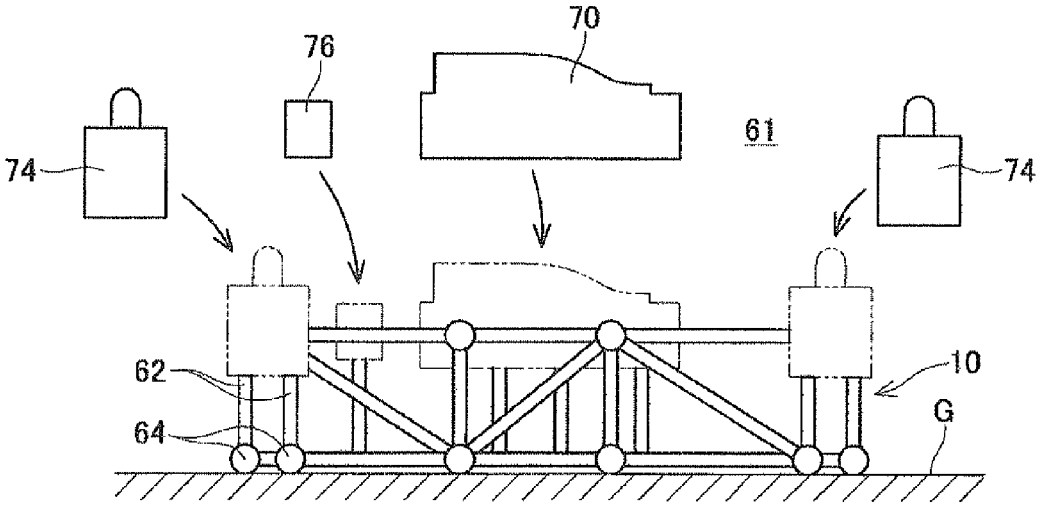
FIG. 6 is a figure illustrating an assembly process.

(Assembly Process) Next, the parts to which the mold lubricant has been applied are assembled (FIG. 6). The assembly is performed on a work plane G. Here, the work plane G is a metal plate that has been prepared on a floor. In the assembly, first, the frame 10 is assembled from the rod pattern parts 62 and the joint pattern parts 64, and then the design block pattern part 70, the positioning block pattern parts 74 and the supporting block pattern part 76 are incorporated into the frame 10. By assembling the frame 10 first, assembly becomes easy. Thus, an evaporative pattern 61 is completed. Further, one of the parts to be joined may be provided with a bayonet cap into which the other part is inserted, or may be provided with a stopper which limits the depth of insertion to a predetermined depth.

Figure 7:
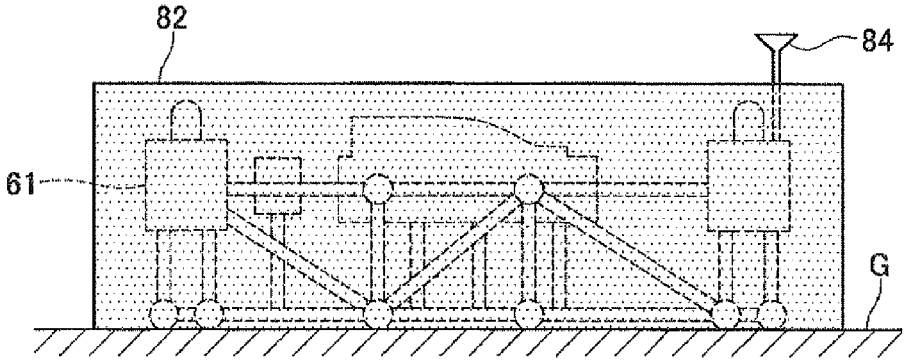
FIG. 7 is a figure illustrating a sand mold manufacturing process.

(Sand Mold Manufacturing Process) Next, the evaporative pattern 61 is covered with sand, making the sand mold (FIG. 7). Here, after the evaporative pattern 61 has been assembled on the work plane, a sand mold 82 is created without moving the evaporative pattern 61. Specifically, the assembled evaporative pattern 61 may be enclosed by a wall, and sand is put therein. Moreover, the reference number 84 of FIG. 7 is a guide pipe for pouring molten metal into a cavity, and is attached to the evaporative pattern 61 before the sand is filled into the sand mold 82. Here, "cavity" means the space occupied by the evaporative pattern 61 in the sand mold 82.

Figure 8:
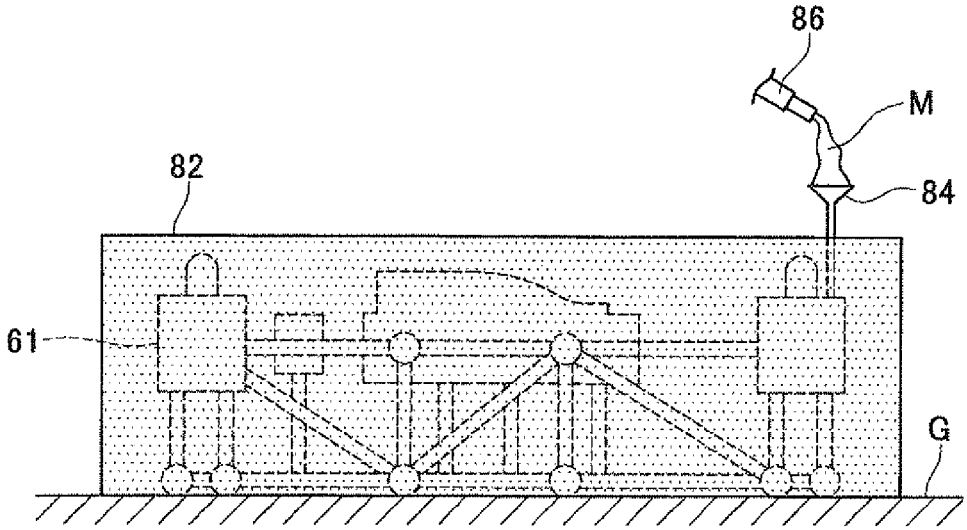
FIG. 8 is a figure illustrating a molten metal pouring process.

(Molten Metal Pouring Process) Next, the molten metal is poured into the sand mold 82 (FIG. 8). Molten metal M is poured from a molten metal supply device 86 through the guide pipe 84 into the cavity of the sand mold 82. The molten metal M is, for example, JIS FC300 or FCD540. FC300 is the material generally called gray cast iron, and FCD540 is the material generally called ductile cast iron. When the molten metal M is poured, the evaporative pattern 61 is melted by the heat of the molten metal. Thereupon, the space (cavity) that was occupied by the evaporative pattern 61 is filled by the molten metal M.

Figure 9:
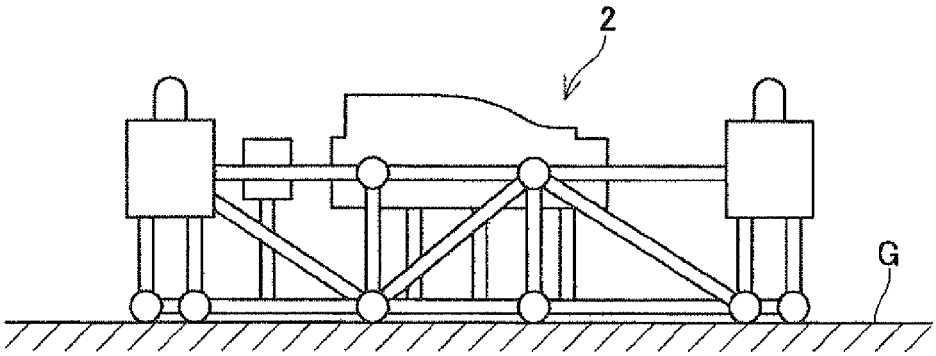
FIG. 9 is a figure illustrating a sand removal process.

(Sand Removal Process) After the molten metal M has cooled and solidified, the sand mold is demolished (FIG. 9). Thus, the mold 2 is completed. In the above casting method, after the evaporative pattern has been assembled on the work plane, the sand mold is constructed and the molten metal is poured without moving the evaporative pattern 61 at all. Consequently, the accuracy of dimensions of the evaporative pattern 61 does not change after assembly. The evaporative pattern is made from polystyrene foam which has low structural strength (rigidity). Consequently, particularly large evaporative patterns bend upon being lifted, reducing their accuracy. In the casting method of the present embodiment, the sand mold is made without moving the evaporative pattern, and consequently the reduction in accuracy does not occur.

Figure 10:
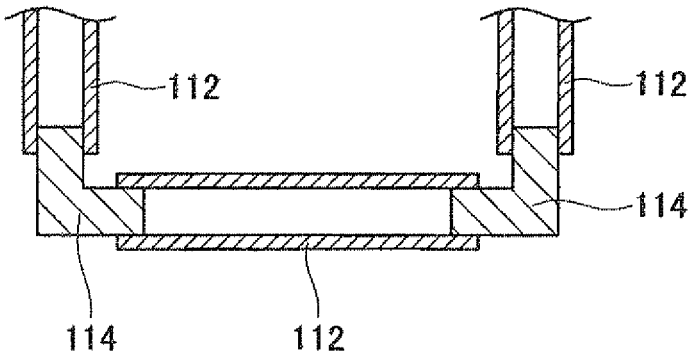
FIG. 10 is a figure illustrating a modification (part) of the evaporative pattern.

A modification of the evaporative pattern will be described with reference to FIG. 10. The evaporative pattern 61 has a framework structure having a plurality of rods (formed from the pattern parts 62 corresponding to the rods). The evaporative pattern having this framework structure may be configured of hollow pipes 112 and joints 114 connecting the pipes. Since the framework structure is configured of the hollow pipes, the flow of molten metal is improved, The pipes 112 and the joints 114 may be made from differing materials. For example, the pipes 112 may be made from paper, and the joints 114 may be made from polystyrene foam. It is noted that "paper" is also a type of the evaporative material.

Specific examples of the present invention are described above in detail, but these examples are merely illustrative and place no limitation on the scope of the claims. The technology described in the claims also encompasses various changes and modifications to the specific examples described above. The technical elements explained in the present specification or drawings provide technical utility either independently or through various combinations. The present invention is not limited to the combinations described at the time the claims are filed. Further, the purpose of the examples illustrated by the present specification or drawings is to satisfy multiple objectives simultaneously, and satisfying any one of those objectives gives technical utility to the present invention.

LIST OF REFERENCE SIGNS

2, 42: Molds, 10: Frame, 12: Rod, 14: Joint, 20, 40: Design blocks, 24: Positioning block, 25: Guide pin, 26, 46: Supporting blocks, 45: Guide bush, 50: Press machine, 51: Bolster, 52: Slider, 53: Support, 55: Actuator, 61: Evaporative pattern, 62, 64, 70, 74, 76: Pattern parts, 80: Spray, 82: Sand mold, 86: Molten metal supply device, 112: Pipe, 114: Joint

The invention claimed is:

1. A method of manufacturing a mold for press forming employing an evaporative pattern, the method comprising:

manufacturing the evaporative pattern as a plurality of separate parts;

assembling the plurality of parts on a work plane;

forming a sand mold by covering the evaporative pattern with sand without moving the evaporative pattern from the work plane on which the evaporative pattern is assembled;

pouring molten metal into the sand mold; and removing the sand after the molten metal has solidified.

wherein the evaporative pattern comprises:

a positioning block for positioning the evaporative pattern relative to a contraposed mold;

a design block having a design surface for transcribing a target shape to a workpiece; and a plurality of rods connecting the positioning block and the design block, wherein the positioning block, the design block and the plurality of rods are manufactured separately.

* * * * *